US008215076B2

(12) United States Patent
Pervan et al.

(10) Patent No.: US 8,215,076 B2
(45) **Date of Patent: *Jul. 10, 2012**

(54) LOCKING SYSTEM, FLOORBOARD COMPRISING SUCH A LOCKING SYSTEM, AS WELL AS METHOD FOR MAKING FLOORBOARDS

(75) Inventors: Darko Pervan, Viken (SE); Tony Pervan, Stockholm (SE)

(73) Assignee: Välinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 12/959,971

(22) Filed: Dec. 3, 2010

(65) Prior Publication Data

US 2011/0072754 A1 Mar. 31, 2011

Related U.S. Application Data

(63) Continuation of application No. 11/822,698, filed on Jul. 9, 2007, now Pat. No. 7,874,119, which is a continuation of application No. 09/954,064, filed on Sep. 18, 2001, now Pat. No. 7,484,338, which is a continuation of application No. PCT/SE00/00785, filed on Apr. 26, 2000.

(30) Foreign Application Priority Data

Apr. 30, 1999 (SE) ..... 9901574

(51) Int. Cl.
*E04B 5/02* (2006.01)
*E04B 5/43* (2006.01)

(52) U.S. Cl. ..... 52/588.1; 52/589.1; 52/592.1; 52/590.2; 52/586.2

(58) Field of Classification Search ..... 52/588.1, 52/578, 581, 589.1, 590.2, 592.1, 574, 480, 52/579, 586.2, 584.1
See application file for complete search history.

(56) References Cited

U.S. PATENT DOCUMENTS 213,740 A 4/1879 Conner (Continued)

FOREIGN PATENT DOCUMENTS

CA 991373 6/1976

(Continued)

OTHER PUBLICATIONS

Pervan, Darko, U.S. Appl. No. 13/105,236, entitled "Locking System for Mechanical Joining of Floorboards and Method for Production Thereof," filed in the U.S. Patent and Trademark Office on May 11, 2011.

(Continued)

*Primary Examiner* — Phi Dieu Tran A

(74) *Attorney, Agent, or Firm* — Buchanan Ingersoll & Rooney PC

(57) ABSTRACT

A locking system for mechanical joining of floorboards constructed from a body, a rear balancing layer and an upper surface layer. A strip, which is integrally formed with the body of the floorboard and which projects from a joint plane and under an adjoining board has a locking element which engages a locking groove in the rear side of the adjoining board. The joint edge provided with the strip is modified with respect to the balancing layer, for example by means of machining of the balancing layer under the strip, in order to prevent deflection of the strip caused by changes in relative humidity. Also, a floorboard provided with such a locking system, as well as a method for making floorboards with such a locking system.

17 Claims, 8 Drawing Sheets

U.S. PATENT DOCUMENTS

| | | | | |
|---|---|---|---|---|
| 1,371,856 | A | 3/1921 | Cade | |
| 1,995,264 | A | 3/1935 | Mason | |
| 2,123,409 | A | 7/1938 | Elemdorf | |
| 2,430,200 | A | 11/1947 | Wilson | |
| 2,740,167 | A | 4/1956 | Rowley | |
| 2,805,852 | A | 9/1957 | Malm | |
| 2,894,292 | A | 7/1959 | Gramelspacher | |
| 2,928,456 | A | 3/1960 | Potchen et al. | |
| 3,200,553 | A | 8/1965 | Frashour | |
| 3,204,380 | A | 9/1965 | Smith | |
| 3,282,010 | A | 11/1966 | King, Jr. | |
| 3,347,048 | A | 10/1967 | Brown et al. | |
| 3,387,422 | A | 6/1968 | Wanzer | |
| 3,538,665 | A | 11/1970 | Gohner | |
| 3,720,027 | A | 3/1973 | Christensen | |
| 3,729,368 | A | 4/1973 | Ingham et al. | |
| 3,842,562 | A | 10/1974 | Daigle | |
| 3,859,000 | A | 1/1975 | Webster | |
| 4,169,688 | A | 10/1979 | Toshio | |
| 4,196,554 | A | 4/1980 | Anderson et al. | |
| 4,426,820 | A | 1/1984 | Terbrack et al. | |
| 4,471,012 | A | 9/1984 | Maxwell | |
| 4,819,932 | A | 4/1989 | Trotter, Jr. | |
| 5,148,850 | A | 9/1992 | Urbanick | |
| 1,898,364 | A | 2/1993 | Gynn | |
| 5,216,861 | A | 6/1993 | Meyerson | |
| 5,253,464 | A | 10/1993 | Nilsen | |
| 5,274,979 | A | 1/1994 | Tsai | |
| 5,295,341 | A | 3/1994 | Kajiwara | |
| 5,474,831 | A | 12/1995 | Nystrom | |
| 5,540,025 | A | 7/1996 | Takehara | |
| 5,653,099 | A | 8/1997 | MacKenzie | |
| 5,695,875 | A | 12/1997 | Larsson et al. | |
| 5,706,621 | A | 1/1998 | Pervan | |
| 5,755,068 | A | 5/1998 | Ormiston | |
| 5,797,237 | A | 8/1998 | Finkell, Jr. | |
| 6,006,486 | A * | 12/1999 | Moriau et al. | 52/589.1 |
| 6,101,778 | A | 8/2000 | Martensson | |
| 6,209,278 | B1 | 4/2001 | Tychsen | |
| 6,216,409 | B1 * | 4/2001 | Roy et al. | 52/589.1 |
| 6,591,568 | B1 * | 7/2003 | Pålsson | 52/592.2 |
| 6,647,690 | B1 | 11/2003 | Martensson | |
| 6,682,254 | B1 | 1/2004 | Olofson | |
| 6,874,292 | B2 | 4/2005 | Moriau et al. | |
| 6,898,913 | B2 | 5/2005 | Pervan | |
| 7,040,068 | B2 | 5/2006 | Moriau et al. | |
| 7,055,290 | B2 * | 6/2006 | Thiers | 52/592.2 |
| 7,121,058 | B2 * | 10/2006 | Palsson et al. | 52/592.2 |
| 7,131,242 | B2 * | 11/2006 | Martensson et al. | 52/591.3 |
| 7,251,916 | B2 * | 8/2007 | Konzelmann et al. | 52/592.1 |
| 7,441,384 | B2 * | 10/2008 | Miller et al. | 52/589.1 |
| 7,441,385 | B2 * | 10/2008 | Palsson et al. | 52/589.1 |
| 7,484,338 | B2 * | 2/2009 | Pervan et al. | 52/588.1 |
| 7,596,920 | B2 * | 10/2009 | Konstanczak | 52/589.1 |
| 7,603,826 | B1 * | 10/2009 | Moebus | 52/592.1 |
| 7,632,561 | B2 * | 12/2009 | Thiers | 428/151 |
| 7,775,007 | B2 | 8/2010 | Pervan | |
| 7,779,596 | B2 | 8/2010 | Pervan | |
| 7,823,359 | B2 | 11/2010 | Pervan | |
| 7,845,133 | B2 | 12/2010 | Pervan | |
| 7,856,785 | B2 | 12/2010 | Pervan | |
| 7,874,119 | B2 * | 1/2011 | Pervan et al. | 52/578 |
| 7,913,471 | B2 | 3/2011 | Pervan | |
| 2002/0178674 | A1 | 12/2002 | Pervan | |
| 2005/0102937 | A1 | 5/2005 | Pervan | |
| 2008/0000182 | A1 | 1/2008 | Pervan | |
| 2008/0005992 | A1 | 1/2008 | Pervan | |
| 2008/0028707 | A1 | 2/2008 | Pervan | |
| 2010/0229491 | A1 | 9/2010 | Pervan | |
| 2010/0275546 | A1 | 11/2010 | Pervan | |

FOREIGN PATENT DOCUMENTS

| | | | |
|---|---|---|---|
| DE | 1 212 275 | B | 3/1966 |
| DE | 2 159 042 | A1 | 6/1973 |
| DE | 26 16 077 | A1 | 10/1977 |
| DE | 30 41 781 | A1 | 6/1982 |
| DE | 33 43 601 | A1 | 6/1985 |
| DE | 35 38 538 | A1 | 5/1987 |
| DE | 39 18 676 | A1 | 8/1990 |
| DE | 41 30 115 | A1 | 3/1993 |
| DE | 42 42 530 | A1 | 6/1994 |
| DE | 198 51 200 | C1 | 3/2000 |
| EP | 0 652 340 | A1 | 5/1995 |
| EP | 0 849 416 | A2 | 6/1998 |
| FR | 1 293 043 | A | 5/1962 |
| GB | 812671 | | 4/1959 |
| GB | 1 430 423 | A | 3/1976 |
| GB | 2 256 023 | A | 11/1992 |
| JP | 1-178659 | A | 7/1989 |
| JP | 3-169967 | A | 7/1991 |
| JP | 6-320510 | A | 11/1994 |
| JP | 7-180333 | A | 7/1995 |
| JP | 7-300979 | A | 11/1995 |
| JP | 7-310426 | A | 11/1995 |
| SE | 372 051 | B | 12/1974 |
| SE | 450 141 | B | 6/1987 |
| SE | 502 994 | C2 | 3/1996 |
| WO | WO 84/02155 | A1 | 6/1984 |
| WO | WO 92/17657 | A1 | 10/1992 |
| WO | WO 93/13280 | A1 | 7/1993 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 98/24994 | A1 | 6/1998 |
| WO | WO 98/24995 | A1 | 6/1998 |
| WO | WO 99/66151 | A1 | 12/1999 |
| WO | WO 99/66152 | A1 | 12/1999 |
| WO | WO 00/47841 | A1 | 8/2000 |
| WO | WO 00/66856 | A1 | 11/2000 |

OTHER PUBLICATIONS

U.S. Appl. No. 13/105,236, filed May 11, 2011, Pervan.

Pervan, Darko, U.S. Appl. No. 13/099,488, entitled "Locking System and Flooring Board," filed in the U. S. Patent and Trademark Office on May 3, 2011.

Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.

* cited by examiner

PRIOR ART

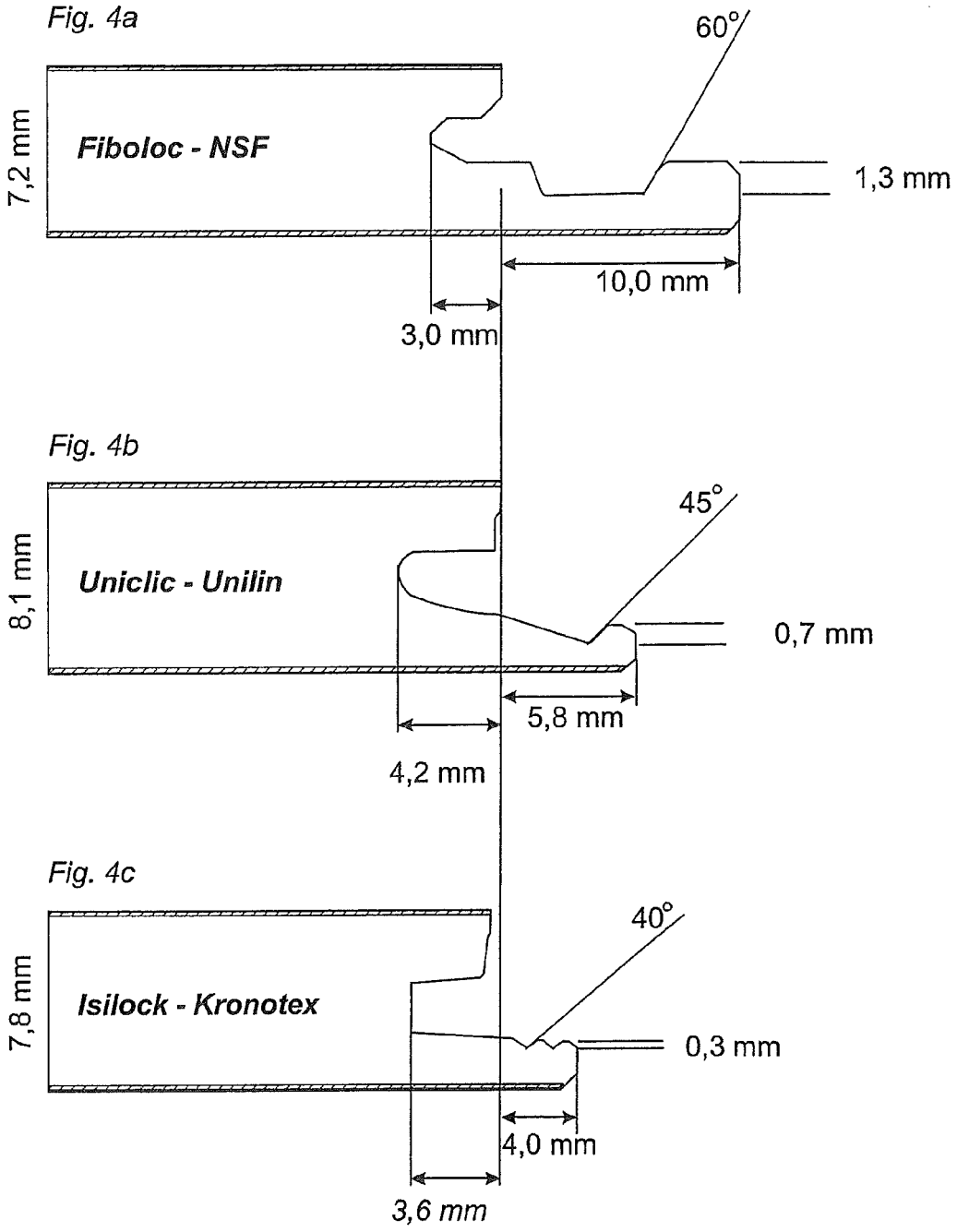
PRIOR ART

LOCKING SYSTEM, FLOORBOARD COMPRISING SUCH A LOCKING SYSTEM, AS WELL AS METHOD FOR MAKING FLOORBOARDS

CROSS REFERENCE TO RELATED APPLICATIONS

The present application is a continuation of U.S. application Ser. No. 11/822,698, filed on Jul. 9, 2007, which is a continuation of U.S. application Ser. No. 09/954,064, filed on Sep. 18, 2001, which is a continuation of Application No. PCT/SE00/00785, filed on Apr. 26, 2000 claims the benefit of Swedish Application No. 9901574-5, filed on Apr. 30, 1999. The entire contents of each of U.S. application Ser. No. 11/822,698, U.S. application Ser. No. 09/954,064, Application No. PCT/SE00/00785 and Swedish Application No. 0303273-7 are hereby incorporated herein by reference.

TECHNICAL FIELD

The invention generally relates to the field of mechanical locking of floorboards. The invention relates to an improved locking system for mechanical locking of floorboards, a floorboard provided with such an improved locking system, as well as a method for making such floorboards. The invention generally relates to an improvement to a locking system of the type described and shown in WO 9426999.

More specifically, the invention relates to a locking system for mechanical joining of floorboards of the type having a body, opposite first and second joint edge portions and a balancing layer on a rear side of the body, adjoining floorboards in a mechanically joined position having their first and second joint edge portions joined at a vertical joint plane, said locking system comprising a) for vertical joining of the first joint edge portion of the first floorboard and the second joint edge portion of the adjoining floorboard mechanically cooperating means in the form of a tongue groove formed in the first joint edge portion and a tongue formed in the second joint edge portion, b) for horizontal joining of the first joint edge portion of the first floorboard and the second joint edge portion of an adjoining floorboard mechanically cooperating means, which comprise a locking groove which is formed in the underside of said second floorboard and which extends parallel to and at a distance from the vertical joint plane at said second joint edge portion and which has a downward opening, and a strip made in one piece with the body of said first floorboard, which strip at said first joint edge portion projects from said vertical joint plane and at a distance from the joint plane has a locking element, which projects towards a plane containing the upper side of said first floorboard and which has at least one operative locking surface for coaction with said locking groove, and said strip forming a horizontal extension of the first joint edge portion below the tongue groove.

FIELD OF APPLICATION OF THE INVENTION

The present invention is particularly suitable for mechanical joining of thin floating floorboards made up of an upper surface layer, an intermediate fibreboard body and a lower balancing layer, such as laminate flooring and veneer flooring with a fibreboard body. Therefore, the following description of the state of the art, problems associated with known systems, and the objects and features of the invention will, as a non-restricting example, focus on this field of application and, in particular, on rectangular floorboards with dimensions of about 1.2 m*0.2 m and a thickness of about 7-10 mm, intended to be mechanically joined at the long side as well as the short side.

BACKGROUND OF THE INVENTION

Thin laminate flooring and wood veneer flooring are usually composed of a body consisting of a 6-9 mm fibreboard, a 0.2-0.8-mm-thick upper surface layer and a 0.1-0.6 mm lower balancing layer. The surface layer provides appearance and durability to the floorboards. The body provides stability, and the balancing layer keeps the board level when the relative humidity (RH) varies during the year. The RH can vary between 15% and 90%. Conventional floorboards of this type are usually joined by means of glued tongue-and-groove joints at the long and short sides. When laying the floor, the boards are brought together horizontally, whereby a projecting tongue along the joint edge of a first board is introduced into the tongue groove along the joint edge of a second board. The same method is used on both the long and the short side. The tongue and the tongue groove are designed for such horizontal joining only and with special regard to how the glue pockets and gluing surfaces should be designed to enable the tongue to be efficiently glued within the tongue groove. The tongue-and-groove joint presents coacting upper and lower contact surfaces that position the boards vertically in order to ensure a level surface of the finished floor.

In addition to such conventional floors which are connected by means of glued tongue-and-groove joints, floorboards have recently been developed which are instead mechanically joined and which do not require the use of glue. This type of a mechanical joint system is hereinafter referred to as a "strip-lock system" since the most characteristic component of this system is a projecting strip which supports a locking element.

WO 9426999 (Applicant Valinge Aluminum AB) discloses a strip-lock system for joining building panels, particularly floorboards. This locking system allows the boards to be locked mechanically at right angles to as well parallel to the principal plane of the boards at the long side as well as at the short side. Methods for making such floorboards are disclosed in WO 9824994 and WO 9824995. The basic principles of the design and the installation of the floorboards, as well as the methods for making the same, as described in the three above-mentioned documents are usable for the present invention as well, and, therefore, these documents are hereby incorporated by reference.

In order to facilitate the understanding and description of the present invention, as well as the comprehension of the problems underlying the invention, a brief description of the basic design and function of the floorboards according to the above-mentioned WO 9426999 will be given below with reference to FIGS. 1-3 in the accompanying drawings. Where applicable, the following description of the prior art also applies to the embodiments of the present invention described below.

FIGS. 3*a* and 3*b* are thus a bottom view and a top view respectively of a known floorboard 1. The board 1 is rectangular with a top side 2, an underside 3, two opposite long sides 4*a*, 4*b* forming joint edges, and two opposite short sides 5*a*, 5*b* forming joint edges.

Without the use of glue, both the long sides 4*a*, 4*b* and the short sides 5*a*, 5*b* can be joined mechanically in a direction D2 in FIG. 1*c*. For this purpose, the board 1 has a flat strip 6, mounted at the factory, projecting horizontally from its long side 4*a*, which strip extends throughout the length of the long side 4*a* and which is made of flexible, resilient sheet aluminum. The strip 6 can be fixed mechanically according to the embodiment shown, or by means of glue, or in some other way. Other strip materials can be used, such as sheets of other metals, as well as aluminum or plastic sections. Alternatively, the strip 6 may be made in one piece with the board 1, for example by suitable working of the body of the board 1. Thus, the present invention is usable for floorboards in which the strip is integrally formed with the board. At any rate, the strip 6 should always be integrated with the board 1, i.e. it should never be mounted on the board 1 in connection with the laying of the floor. The strip 6 can have a width of about 30 mm and a thickness of about 0.5 mm. A similar, but shorter strip 6' is provided along one short side 5*a* of the board 1. The edge side of the strip 4 facing away from the joint edge 4*a* is formed with a locking element 8 extending throughout the length of the strip 6. The locking element 8 has an operative locking surface 10 facing the joint edge 4*a* and having a height of e.g. 0.5 mm. When the floor is being laid, this locking surface 10 coacts with a locking groove 14 formed in the underside 3 of the opposite long side 4*b* of an adjoining board 1'. The short side strip 6' is provided with a corresponding locking element 8', and the opposite short side 5*b* has a corresponding locking groove 14'.

Moreover, for mechanical joining of both the long sides and the short sides also in the vertical direction (direction D1 in FIG. 1*c*), the board 1 is formed with a laterally open recess 16 along one long side 4*a* and one short side 5*a*. At the bottom, the recess is defined by the respective strips 6, 6'. At the opposite edges 4*b* and 5*b*, there is an upper recess 18 defining a locking tongue 20 coacting with the recess 16 (see FIG. 2*a*).

FIGS. 1*a*-1*c* show how two long sides 4*a*, 4*b* of two such boards 1, 1' on an underlay U can be joined together by means of downward angling. FIGS. 2*a*-2*c* show how the short sides 5*a*, 5*b* of the boards 1, 1' can be joined together by snap action. The long sides 4*a*, 4*b* can be joined together by means of both methods, while the short sides 5*a*, 5*b*—when the first row has been laid—are normally joined together subsequent to joining together the long sides 4*a*, 4*b* and by means of snap action only.

When a new board 1' and a previously installed board 1 are to be joined together along their long sides 4*a*, 4*b* as shown in FIGS. 1*a*-1*c*, the long side 4*b* of the new board 1' is pressed against the long side 4*a* of the previous board 1 as shown in FIG. 1*a*, so that the locking tongue 20 is introduced into the recess 16. The board 1' is then angled downwards towards the subfloor 12 as shown in FIG. 1*b*. In this connection, the locking tongue 20 enters the recess 16 completely, while the locking element 8 of the strip 6 enters the locking groove 14. During this downward angling the upper part 9 of the locking member 8 can be operative and provide guiding of the new board 1' towards the previously installed board 1. In the joined position as shown in FIG. 1*c*, the boards 1, 1' are locked in both the direction D1 and the direction D2 along their long sides 4*a*, 4*b*, but can be mutually displaced in the longitudinal direction of the joint along the long sides 4*a*, 4*b*.

FIGS. 2*a*-2*c* show how the short sides 5*a* and 5*b* of the boards 1, 1' can be mechanically joined in the direction D1 as well as the direction D2 by moving the new board 1' towards the previously installed board 1 essentially horizontally. Specifically, this can be carried out subsequent to joining the long side of the new board 1' to a previously installed board in an adjoining row by means of the method according to FIGS. 1*a*-1*c*. In the first step in FIG. 2*a*, beveled surfaces adjacent to the recess 16 and the locking tongue 20 respectively cooperate such that the strip 6' is forced to move downwards as a direct result of the bringing together of the short sides 5*a*, 5*b*. During the final urging together of the short sides, the strip 6' snaps up when the locking element 8' enters the locking groove 14'.

By repeating the steps shown in FIGS. 1*a*-*c* and 2*a*-*c*, the whole floor can be laid without the use of glue and along all joint edges. Known floorboards of the above-mentioned type are thus mechanically joined usually by first angling them downwards on the long side, and when the long side has been secured, snapping the short sides together by means of horizontal displacement along the long side. The boards 1, 1' can be taken up in the reverse order of laying without causing any damage to the joint, and be laid again. These laying principles are also applicable to the present invention.

For optimal function, subsequent to being joined together, the boards should be capable of assuming a position along their long sides in which a small play can exist between the locking surface 10 and the locking groove 14. Reference is made to WO 9426999 for a more detailed description of this play.

In addition to what is known from the above-mentioned patent specifications, a licensee of Valinge Aluminum AB, Norske Skog Flooring AS (NSF), introduced a laminated floor with mechanical joining according to WO 9426999 in January 1996 in connection with the Domotex trade fair in Hannover, Germany. This laminated floor, which is marketed under the brand name Alloc™, is 7.2 mm thick and has a 0.6-mm aluminum strip 6 which is mechanically attached on the tongue side. The operative locking surface 10 of the locking element 8 has an inclination (hereinafter termed locking angle) of 80° to the plane of the board. The vertical connection is designed as a modified tongue-and-groove joint, the term "modified" referring to the possibility of bringing the tongue and tongue groove together by way of angling.

WO 9747834 (Applicant Unilin) describes a strip-lock system which has a fibreboard strip and is essentially based on the above known principles. In the corresponding product, "Uniclic", which this applicant began marketing in the latter part of 1997, one seeks to achieve biasing of the boards. This results in high friction and makes it difficult to angle the boards together and to displace them. The document shows several embodiments of the locking system. The "Uniclic" product, shown in section in FIG. 4*b*, consists of a floorboard having a thickness of 8.1 mm with a strip having a width of 5.8 mm, comprising an upper part made of fibreboard and a lower part composed of the balancing layer of the floorboard. The strip has a locking element 0.7 mm in height with a locking angle of 45°. The vertical connection consists of a tongue and a tongue groove having a tongue groove depth of 4.2 mm.

Other known locking systems for mechanical joining of board materials are described in, for example, GB-A-2,256,023 showing unilateral mechanical joining for providing an expansion joint in a wood panel for outdoor use, and in U.S. Pat. No. 4,426,820 showing a mechanical locking system for plastic sports floors, which floor however does not permit displacement and locking of the short sides by snap action. In both these known locking systems the boards are uniform and do not have a separate surface layer and balancing layer.

In the autumn of 1998, NSF introduced a 7.2-mm laminated floor with a strip-lock system which comprises a fibreboard strip and is manufactured in accordance with WO 9426999. This laminated floor, which is shown in cross-section in FIG. 4*a*, is marketed under the brand name of "Fiboloc™". In this case, too, the strip comprises an upper part of fibreboard and a lower part composed of a balancing layer. The strip is 10.0 mm wide, the height of the locking element is 1.3 mm and the locking angle is 60°. The depth of the tongue groove is 3.0 mm.

In January 1999, Kronotex introduced a 7.8 mm thick laminated floor with a strip lock under the brand name "Isilock". This system is shown in cross-section in FIG. 4*c*. In this floor, too, the strip is composed of fibreboard and a balancing layer. The strip is 4.0 mm and the tongue groove depth is 3.6 mm. "Isilock" has two locking ridges having a height of 0.3 mm and with locking angles of 40°. The locking system has low tensile strength, and the floor is difficult to install.

SUMMARY OF THE INVENTION

Although the floor according to WO 9426999 and the floor sold under the brand name Fiboloc™ exhibit major advantages in comparison with traditional, glued floors, further improvements are desirable mainly by way of cost savings which can be achieved by reducing the width of the fibreboard strip from the present 10 mm. A narrower strip has the advantage of producing less material waste in connection with the forming of the strip. However, this has not been possible since narrower strips of the Uniclic and Isilock type have produced inferior test results. The reason for this is that narrow strips require a small angle of the locking surface of the locking element in relation to the horizontal plane (termed locking angle) in order to enable the boards to be joined together by means of angling, since the locking groove follows an arc having its centre in the upper joint edge of the board. The height of the locking element must also be reduced since narrow strips are not as flexible, rendering snap action more difficult.

To sum up, narrow strips have the advantage that material waste is reduced, but the drawbacks that the locking angle must be small to permit angling and that the locking element must be low to permit joining by snap action.

In repeated laying trials and tests with the same batch of floorboards we have discovered that strip locks, which have a joint geometry similar to that in FIGS. 4*b* and 4*c*, and are composed of a narrow fibreboard strip with a balancing layer on its rear side and with a locking element having a small locking surface with a low locking angle, exhibit a considerable number of properties which are not constant and which can vary substantially in the same floorboard at different points in time when laying trials have been performed. These problems and the reason behind the problems are not known.

Moreover, at present there are no known products or methods which afford adequate solutions to these problems which are related to (i) mechanical strength of the joint of floorboards with a mechanical locking system of the strip lock type;

(ii) handling and laying of such floorboards;

(iii) properties of a finished, joined floor made of such floorboards. (i) Strength At a certain point in time, the joint system of the floorboards has adequate strength. In repeated testing at a different point in time, the strength of the same floorboard may be considerably lower, and the locking element slides out of the locking groove relatively easily when the floor is subjected to tensile stress transversely of the joint.

(ii) Handling/Laying

At certain times during the year the boards can be joined together, while at other times it is very difficult to join the same floorboard. There is a considerable risk of damage to the joint system in the form of cracking.

(iii) Properties of the Joined Floor

The quality of the joint in the form of the gap between the upper joint edges of the floorboards when subjected to stress varies for the same floorboard at different times during the year.

It is known that floorboards expand and shrink during the year when the relative humidity RH changes. Expansion and shrinking are 10 times greater transversely of the direction of the fibres than in the direction of the fibres. Since both joint edges of the joint system change by the same amount essentially simultaneously, the expansion and the shrinking cannot explain the undesirable effects which severely limit the chances of providing a strip-lock system at a low cost which at the same time is of high quality with respect to strength, laying properties, and the quality of the joint. According to generally known theories, wide strips should expand more and cause greater problems. Our tests indicate that the reverse is the case.

In sum, there is a great need for a strip-lock system which to a greater extent than the prior art takes into account the above-mentioned requirements, problems and wishes. It is an object of the invention to fulfill this need.

These and other objects of the invention are achieved by a locking system, a floorboard, and a manufacturing method exhibiting the properties stated in the appended independent claims, preferred embodiments being stated in the dependent claims.

The invention is based on a first insight according to which the problems identified are essentially connected to the fact that the strip which is integrated with the body bends upwards and downwards when the RH changes. Moreover, the invention is based on the insight that, as a result of its design, the strip is unbalanced and acts as a bimetal. When, in a decrease of the RH, the rear balancing layer of the strip shrinks more than the fibreboard part of the strip, the entire strip will bend backwards, i.e. downwards. Such strip-bending can be as great as about 0.2 mm. A locking element having a small operative locking surface, e.g. 0.5 mm, and a low locking angle, e.g. 45 degrees, will then cause a play in the upper part of the horizontal locking system, which means that the locking element of the strip easily slides out of the locking groove. If the strip is straight or slopes upward it will be extremely difficult to lay the floor if the locking system is adapted to a curved strip.

One reason why the problem is difficult to solve is that the deflection of the strip is not known when the floor is being laid or when it has been taken up and is being laid again, which is one of the major advantages of the strip lock in comparison with glued joints. Consequently, it is not possible to solve the problem by adapting in advance the working measurements of the strip and/or the locking groove to the curvature of the strip, since the latter is unknown.

Nor is it preferred to solve this problem by using a wide strip, whose locking element has a higher locking surface with a larger locking angle, since a wide strip has the drawback of considerable material wastage in connection with the forming of the strip. The reason why the wider but more costly strip works better is mainly because the locking surface is substantially larger than the maximum strip bending and because the high locking angle only causes a marginally greater play which is not visible.

The strip-bending problems are reinforced by the fact that laminate flooring is subjected to unilateral moisture influence. The surface layer and the balancing layer do not cooperate fully, and this always gives rise to a certain amount of bulging. Concave upward bulging is the biggest problem, since this causes the joint edges to rise. The result is an undesirable joint opening between the boards in the upper side of the boards and high wear of the joint edges. Accordingly, it is desirable to provide a floorboard which in normal relative humidity is somewhat upwardly convex by biasing the rear balancing layer. In traditional, glued floors this biasing is not a problem, rather, it creates a desirable advantage. However, in a mechanically joined floor with an integrated strip lock the biasing of the balancing layer results in an undesirable drawback since the bias reinforces the imbalance of the strip and, consequently, causes a greater, undesirable backward bending of the strip. This problem is difficult to solve since the bias is an inherent quality of the balancing layer, and, consequently, cannot be eliminated from the balancing layer.

The invention is also based on a second insight which is related to the geometry of the joint. We have also discovered that a strip lock with a relatively deep tongue groove gives rise to greater undesirable bending of the strip. The reason behind this phenomenon is that the tongue groove, too, is unbalanced. Consequently, the tongue groove opens when, in a decrease of the RH, the balancing layer shrinks to a greater extent than the fibreboard part of the strip, causing the strip to bend downwards since the strip is an extension of the joint edge below the tongue groove.

According to a first aspect of the invention a locking system is provided of the type which is stated in the first paragraph but one of the description and which, according to the invention, is characterized in that the second joint edge, within an area (P) defined by the bottom of the tongue groove and the locking surface of the locking element, is modified with respect to the balancing layer.

Said area P, which is thus defined by the bottom of the tongue groove and the locking surface of the locking element, is the area which is sensitive to bending. If the strip bends within this area P, the position of the locking surface relative to the locking groove, and thus the properties of the joint, will be affected. Especially, it should be noted that this entire area P is unbalanced, since nowhere does the part of the balancing layer located in this area P have a coacting, balancing surface layer, neither in the tongue groove nor on the projecting strip. According to the invention, by modifying the balancing layer within this area P it is possible to change this unbalanced state in a positive direction, such that the undesirable strip-bending is reduced or eliminated.

The term "modified" refers to both (i) a preferred embodiment in which the balancing layer has been modified "over time", i.e. the balancing layer has first been applied across the entire area P during the manufacturing process, but has then been subjected to modifying treatment, such as milling or grooving and/or chemical working, and (ii) variants in which the balancing layer at least across part of the area P has been modified "in space", i.e. that the area P differs from the rest of the board with respect to the appearance/properties/structure of the balancing layer.

The balancing layer can be modified across the entire horizontal extent of the area P, or within only one or several parts thereof. The balancing layer can also be modified under the whole of the locking element or parts thereof. However, it may be preferable to keep the balancing layer intact under at least part of the locking element to provide support for the strip against the underlay.

According to a preferred embodiment, "modifying" means that the balancing layer is completely or partially removed. In one embodiment, the whole area P lacks a balancing layer.

In a second embodiment, there is no balancing layer at all within one or several parts of the area P. Depending on the type of balancing layer and the geometry of the joint system, it is, for example, possible to keep the whole balancing layer or parts thereof under the tongue groove.

In a third embodiment, the balancing layer is not removed completely; it is only reduced in thickness. The latter embodiment can be combined with the former ones. There are balancing layers where the main problems can be eliminated by partial removal of some layers only. The rest of the balancing layer can be retained and helps to increase the strength and flexibility of the strip. Balancing layers can also be specially designed with different layers which are adapted in such a way that they both balance the surface and can act as a support for the strip when parts of the layers are removed within one area of the rear side of the strip.

The modification can also mean a change in the material composition and/or material properties of the balancing layer.

Preferably, the modification can be achieved by means of machining such as milling and/or grinding but it could also be achieved by means of chemical working, heat treatment or other methods which remove material or change material properties.

The invention also provides a manufacturing method for making a moisture-stable strip-lock system. The method according to the invention comprises the steps of

- forming each floorboard from a body,
- providing the rear side of the body with a balancing layer,
- forming the floorboard with first and second joint edge portions,
- forming said first joint edge portion with
  - a first joint edge surface portion extended from the upper side of the floorboard and defining a joint plane along said first joint edge portion,
  - a tongue groove which extends into the body from said joint plane,
  - a strip formed from the body and projecting from said joint plane and supporting at a distance from this joint plane an upwardly projecting locking element with a locking surface facing said joint plane,
- forming said second joint edge portion with
  - a second joint edge surface portion extended from the upper side of the floorboard and defining a joint plane along said second joint edge portion,
  - a tongue projecting from said joint plane for coaction with a tongue groove of the first joint edge portion of an adjoining floorboard, and
  - a locking groove which extends parallel to and at a distance from the joint plane of said second joint edge portion and which has a downward opening and is designed to receive the locking element and cooperate with said locking surface of the locking element.

The method according to the invention is characterized by the step of working the balancing layer within an area defined by the bottom of the tongue groove and the locking surface of the locking element.

The adaptation or removal of part of the balancing layer in the joint system can be carried out in connection with the gluing/lamination of the surface layer, the body, and the balancing layer by displacing the balancing layer relative to the surface layer. It is also possible to carry out modifications in connection with the manufacture of the balancing layer so that the part which will be located adjacent to the locking system will have properties which are different from those of the rest of the balancing layer.

However, a very suitable manufacturing method is machining by means of milling or grinding. This can be carried out in connection with the manufacture of the joint system and the floorboards can be glued/laminated in large batches consisting of 12 or more floorboards.

The strip-lock system is preferably manufactured using the upper floor surface as a reference point. The thickness tolerances of the floorboards result in strips of unequal thickness since there is always a predetermined measurement from the top side of the strip to the floor. Such a manufacturing method results in tongue grooves of different depths in the rear side and a partial removal of a thin balancing layer cannot be performed in a controlled manner. The removal of the balancing layer should thus be carried out using the rear side of the floorboard as a reference surface instead.

It has also been an object to provide a cost-optimal joint which is also of high-quality by making the strip as narrow as possible and the tongue groove as shallow and as strong as possible in order both to reduce waste since the tongue can be made narrow and to eliminate as far as possible the situation where the tongue groove opens up and causes strip-bending as well as rising of the upper joint edge when the relative humidity changes.

Known strip-lock systems with a strip of fibreboard and a balancing layer are characterized in that the shallowest known tongue groove is 3.0 mm in a 7.2-mm-thick floorboard. The depth of the tongue groove is thus 0.42 times the thickness of the floor. This is only known in combination with a 10.0-mm-wide strip which thus has a width which is 1.39 times the floor thickness. All other such known strip joints with narrow strips have a tongue groove depth exceeding 3.6 mm and this contributes considerably to the strip-bending.

In order to fulfill the above-mentioned object a strip-lock system is provided which is characterized in that the tongue groove depth of the tongue groove and the width of the strip are less than 0.4 and 1.3 times the floor thickness respectively. This joint affords good joint properties and especially in combination with high rigidity of the tongue groove since it can be designed in such a way that as much material as possible is retained between the upper part of the tongue groove and the floor surface as well as between the lower part of tongue groove and the rear side of the floor while, at the same time, it is possible to eliminate the strip-bending problems as described above. This strip-lock system can be combined with one or more of the preferred embodiments which are disclosed in connection with the solution based on a modification of the balancing layer.

The opposite joint edge of the board is also unbalanced. In this case, the problems are not nearly as serious since the surface layer is not biased and the unbalanced part is more rigid. However, in this case, too, an improvement can be achieved by making the strip as thin as possible. This permits minimal removal of material in the locking groove part of the joint system, which in turn results in maximum rigidity in this unbalanced part.

According to the invention there is thus provided a strip-lock system having a joint geometry characterized in that there is a predetermined relationship between the width and thickness of the strip and the height of the locking element on the one hand and the floor thickness on the other. Furthermore, there is provided a minimum locking angle for the locking surface. All these parameters separately and in combination with each other and the above inventions contribute to the creation of a strip-lock system which can have high joint quality and which can be manufactured at a low cost.

BRIEF DESCRIPTION OF THE DRAWINGS

FIG. 4 shows three strip-lock systems available on the market with an integrated strip of fibreboard and a balancing layer.

DESCRIPTION OF PREFERRED EMBODIMENTS

Prior to the description of preferred embodiments, with reference to FIGS. 5-8, a detailed explanation will first be given of the background to and the impact of strip-bending.

Figure 1A:
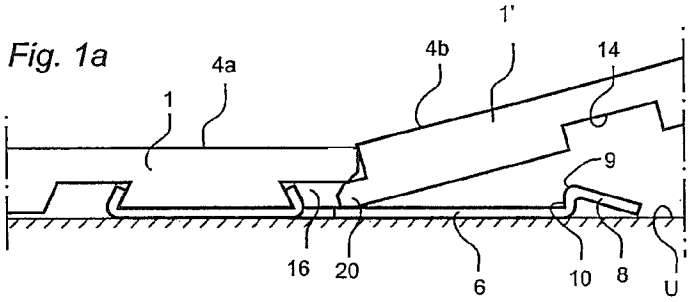
FIGS. 1*a-c* show in three stages a downward angling method for mechanical joining of long sides of floorboards according to WO 9426999.
Figure 1B:
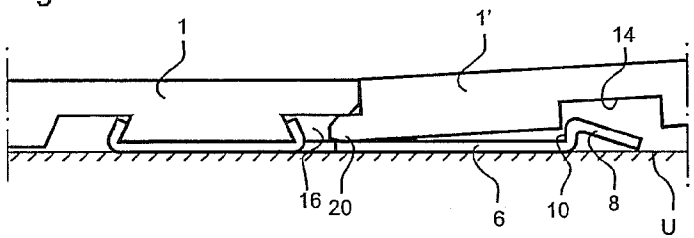
Figure 1C:
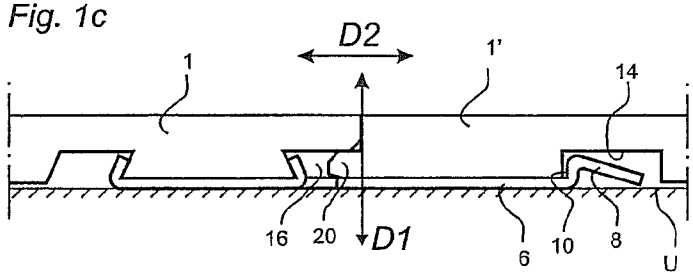
Fig. 1c PRIOR ART
Figure 2A:
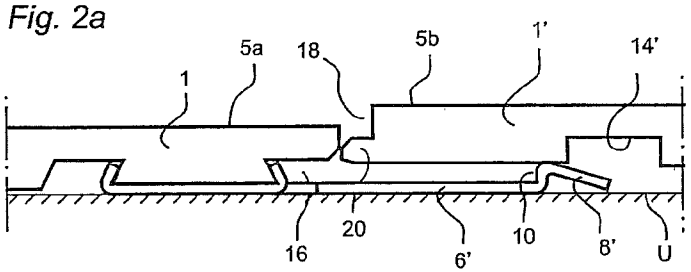
FIGS. 2*a-c* show in three stages a snap-action method for mechanical joining of short sides of floorboards according to WO 9426999.
Figure 2B:
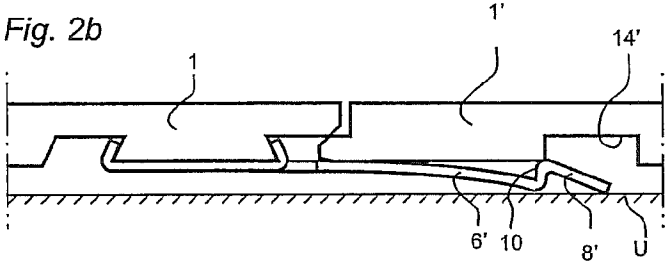
Figure 2C:
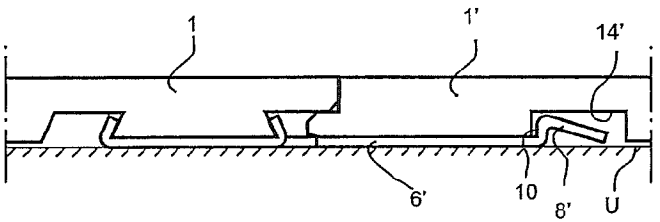
Fig. 2c PRIOR ART
Figure 3A:
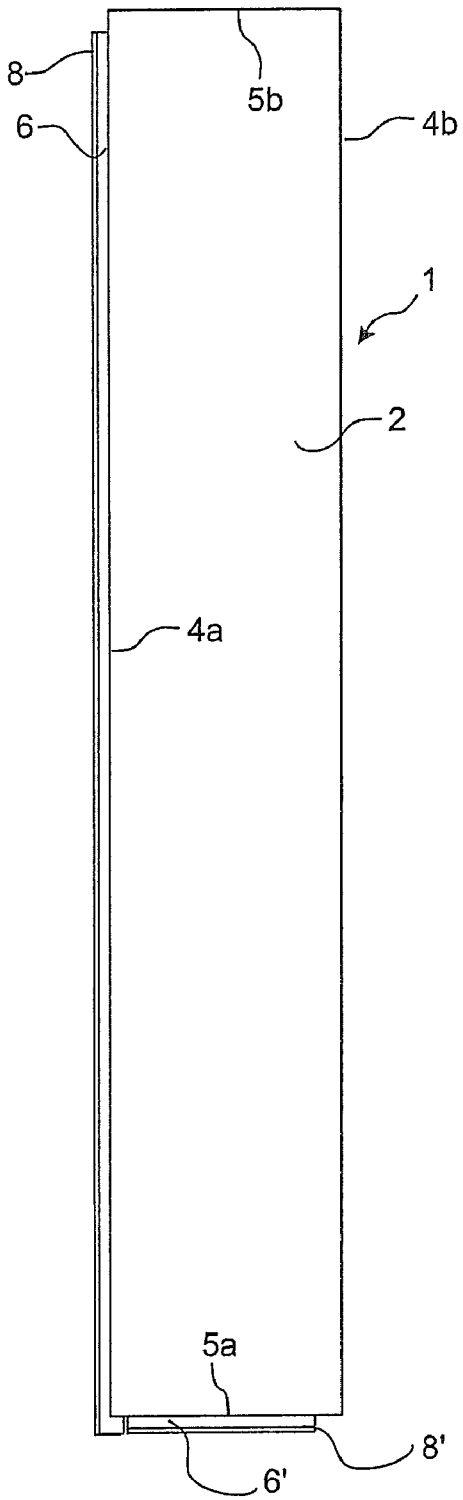
FIGS. 3*a* and 3*b* are a top view and a bottom view respectively of a floorboard according to WO 9426999.
Figure 3B:
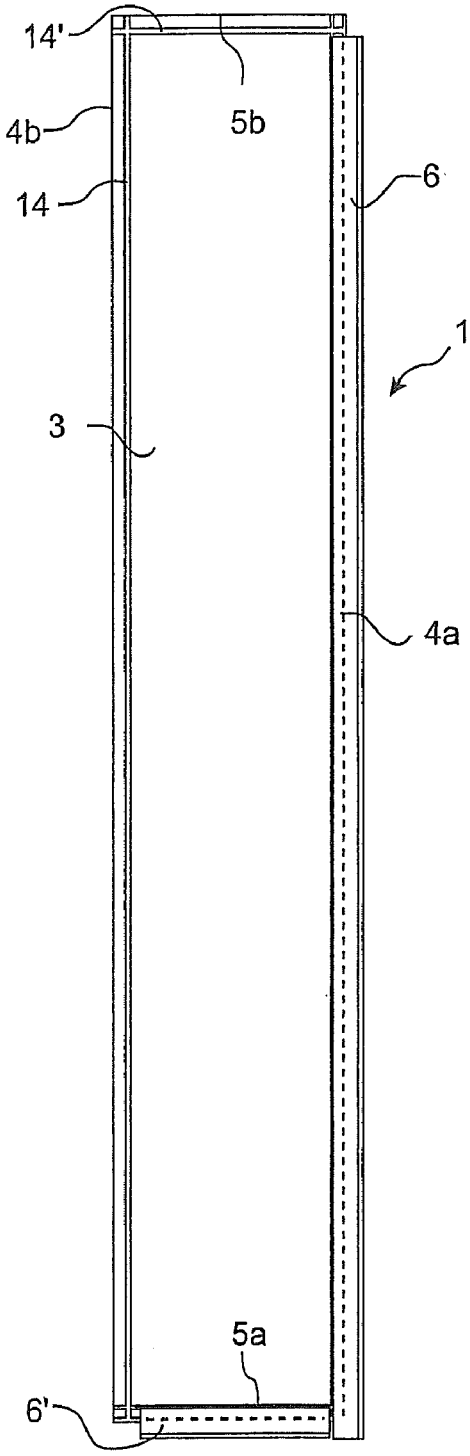
Figure 5:
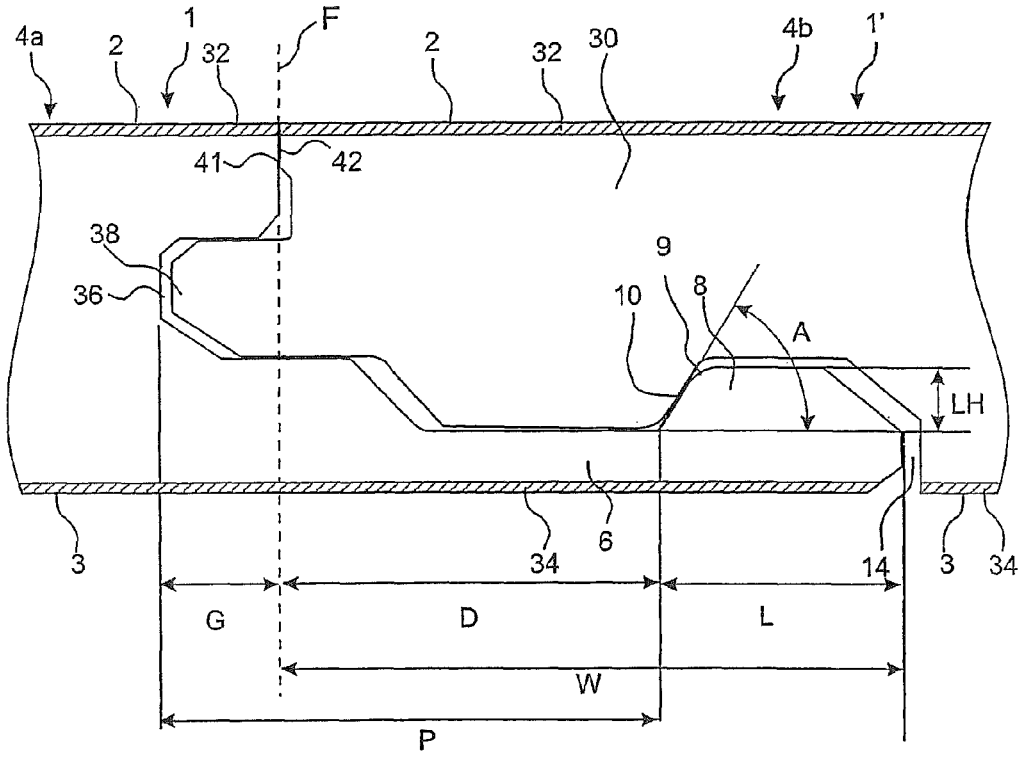
FIG. 5 shows a strip lock with a small tongue groove depth and with a wide fibreboard strip, which supports a locking element having a large locking surface and a high locking angle.
Figure 6:
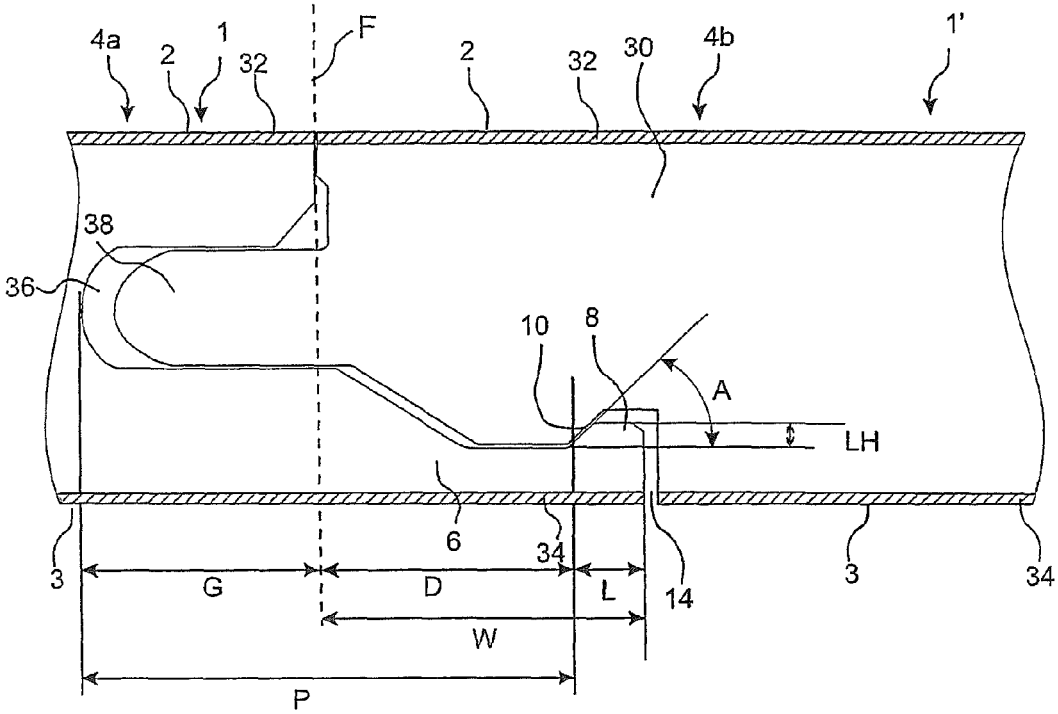
FIG. 6 shows a strip lock with a large tongue groove depth and with a narrow fibreboard strip, which supports a locking element having a small locking surface and a low locking angle.

The cross-sections shown in FIGS. 5 and 6 are hypothetical, unpublished cross-sections, but they are fairly similar to "Fiboloc™" in FIG. 4*a* and "Uniclic" in FIG. 4*b*. Accordingly, FIGS. 5 and 6 do not represent the invention. Parts which correspond to those in the previous Figures are in most cases provided with the same reference numerals. The design, function, and material composition of the basic components of the boards in FIGS. 5 and 6 are essentially the same as in embodiments of the present invention and, consequently, where applicable, the following description of FIGS. 5 and 6 also applies to the subsequently described embodiments of the invention.

In the embodiment shown, the floorboards 1, 1' in FIG. 5 are rectangular with opposite long sides 4*a*, 4*b* and opposite short sides 5*a*, 5*b*. FIG. 5 shows a vertical cross-section of a part of a long side 4*a* of the board 1, as well as a part of a long side 4*b* of an adjoining board 1'. The body of the board 1 can be composed of a fibreboard body 30, which supports a surface layer 32 on its front side and a balancing layer 34 on its rear side. A strip 6 formed from the body and the balancing layer of the floorboard and supporting a locking element 8 constitutes an extension of the lower tongue groove part 36 of the floorboard 1. The strip 6 is formed with a locking element 8, whose operative locking surface 10 cooperates with a locking groove 14 in the opposite joint edge 4*b* of the adjoining board 1' for horizontal locking of the boards 1, 1' transversely of the joint edge (D2). The locking element 8 has a relatively large height LH and a high locking angle A. The upper part of the locking element has a guiding part 9 which guides the floorboard to the correct position in connection with angling. The locking groove 14 has a larger width than the locking element 8, as is evident from the Figures.

For the purpose of forming a vertical lock in the direction D1, the joint edge portion 4*a* exhibits a laterally open tongue groove 36 and the opposite joint edge portion 4*b* exhibits a tongue 38 which projects laterally from a joint plane F and which in the joined position is received in the tongue groove 36.

In the joined position according to FIG. 5, the two adjoining, upper joint edge surface portions 41 and 42 of the boards 1, 1' define this vertical joint plane F.

The strip 6 has a horizontal extent W (=strip width) which can be divided into: (a) an inner part with a horizontal extent D (locking distance) which is defined by the joint plane F and a vertical line through the lower part of the locking surface 10, as well as (b) an outer part with a horizontal extent L (the width of the locking element). The tongue groove 36 has a horizontal tongue groove depth G measured from the joint plane F and inwards towards the board 1 to a vertical limiting plane which coincides with the bottom of the tongue groove 36. The tongue groove depth G and the extent D of the locking distance together form a joint part within an area P consisting of components forming part of the vertical lock D1 and the horizontal lock D2.

FIG. 6 shows an embodiment which is different from the embodiment in FIG. 5 in that the tongue groove depth G is greater, and the strip width W, the height LH, and the locking angle A of the locking surface are all smaller. However, the size of the area P is the same in the embodiments in FIGS. 5 and 6.

Figure 7:
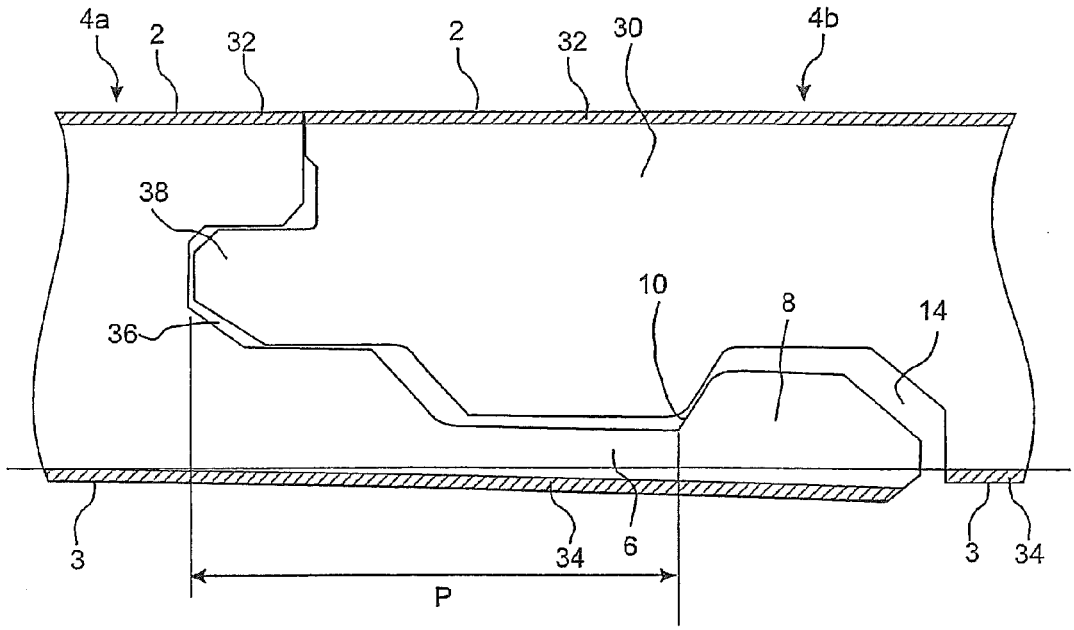
FIGS. 7 and 8 illustrate strip-bending in a strip lock according to FIG. 5 and FIG. 6.
Figure 8:
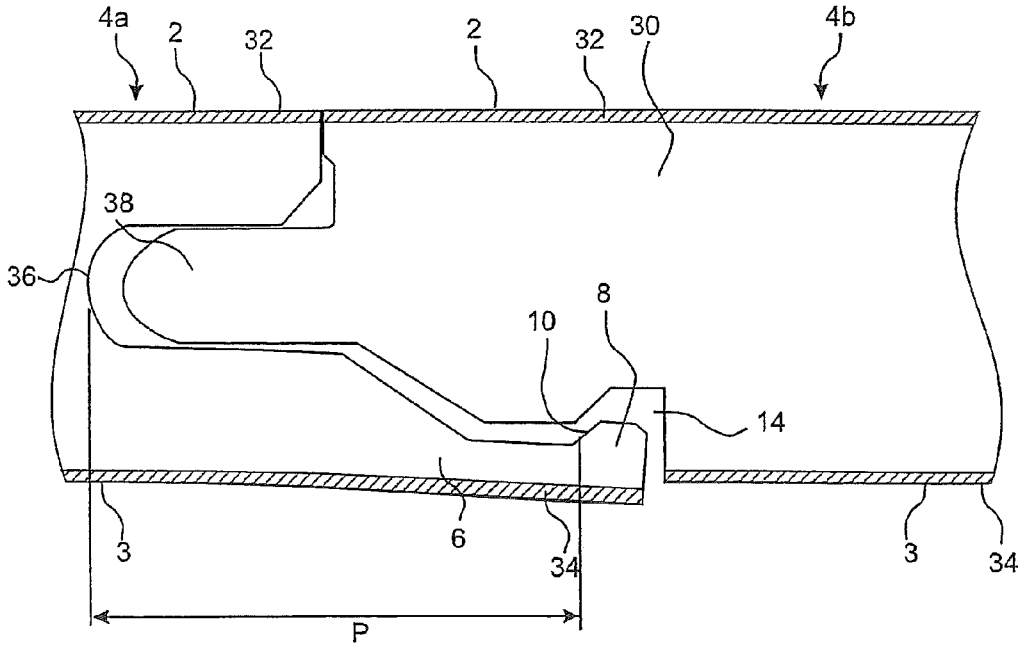

Reference is now made to FIGS. 7 and 8, which show strip-bending in the embodiments in FIGS. 5 and 6 respectively. The relevant part of the curvature which may cause problems is the area P, since a curvature in the area P results in a change of position of the locking surface 10. Since the area P has the same horizontal extent in both embodiments, all else being equal, the strip-bending at the locking surface 10 will be of the same magnitude despite the fact that the strip length W is different.

The large locking surface 10 and the large locking angle A in FIG. 5 will not cause any major problems in FIG. 7, since the greater part of the locking surface 10 is still operative. The high locking angle A contributes only marginally to increased play between the locking element 8 and the locking groove 14. In FIG. 8, however, the large tongue groove depth G as well as the small locking surface 10 and the low locking angle A2 create major problems. The strength of the locking system is considerably reduced and the play between the locking element 8 and the locking groove 14 increases substantially and causes joint openings in connection with tensile stress. If the play of the boards is adapted to a sloping strip at the time of manufacture it may prove impossible to lay the boards if the strip 6 is flat or bent upwards.

We have realized that the strip-bending is a result of the fact that the joint part P is unbalanced and that the shape changes in the balancing layer 34 and the fibreboard part 30 of the strip are not the same when the relative humidity changes. In addition, the bias of the balancing layer 34 contributes to bending the strip 6 backwards/downwards.

The deciding factors of the strip-bending are the extent of the locking distance D and the tongue groove depth G. The appearance of the tongue groove 36 and the strip 6 also has some importance. A great deal of material in the joint portion P makes the tongue groove and the strip more rigid and counteracts strip-bending.

Figure 9:
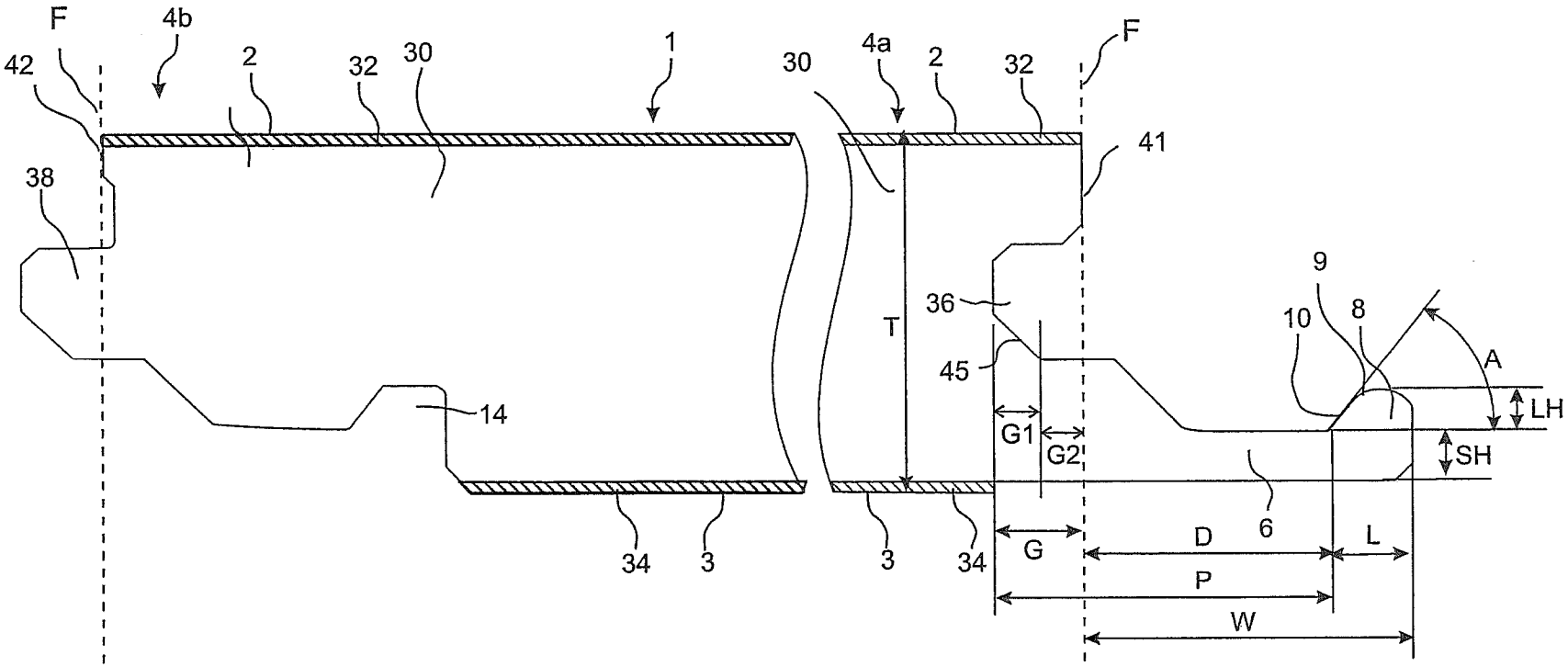
FIG. 9 shows the joint edges of a floorboard according to an embodiment of the invention.
Figure 10:
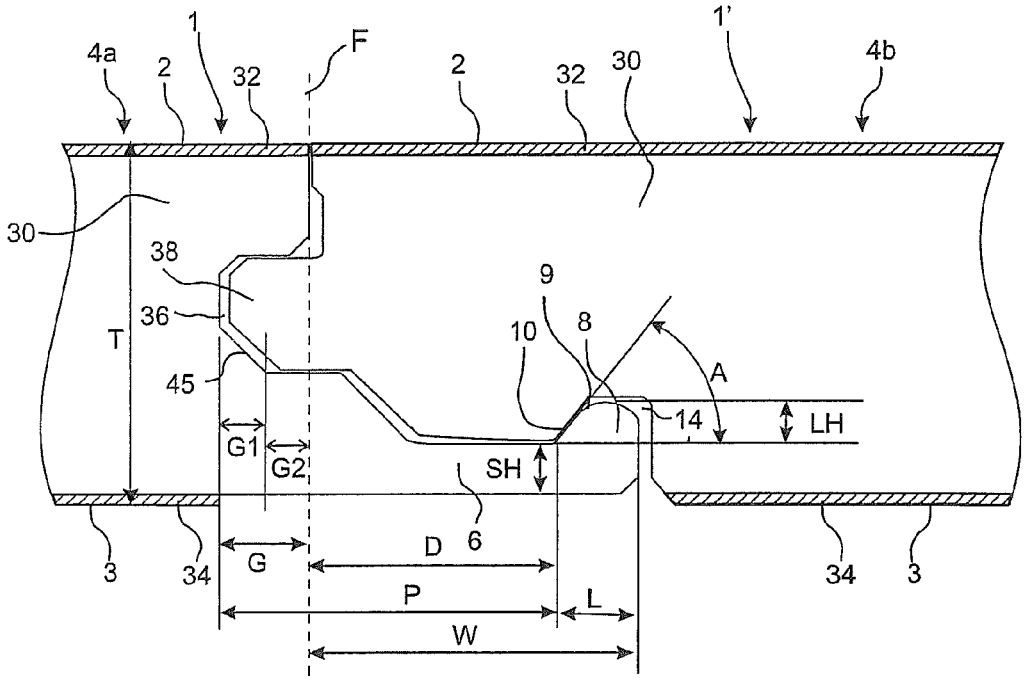
FIGS. 10 and 11 show the joining of two floorboards according to FIG. 9.
Figure 11:
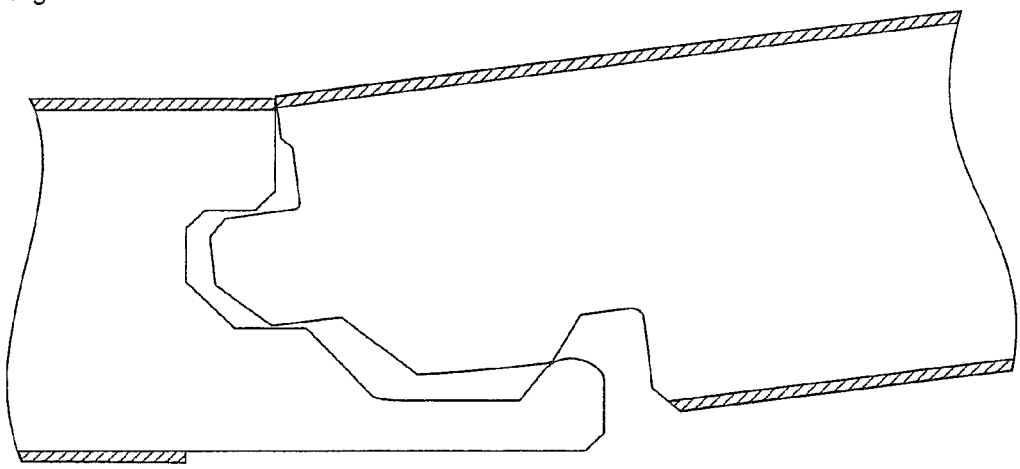

FIGS. 9-11 show how a cost-efficient strip-lock system with a high quality joint can be designed according to the invention. FIG. 9 shows a vertical cross-section of the whole board 1 seen from the short side, with the main portion of the board broken away. FIG. 10 shows two such boards 1, 1' joined at the long sides 4*a*, 4*b*. FIG. 11 shows how the long sides can be angled together in connection with laying and angled upward when being taken up. The short sides can be of the same shape.

In connection with the manufacture of the strip-lock system, the balancing layer 34 has been milled off both in the entire area G under the tongue groove 36 and across the entire rear side of the strip 6 across the width W (including the area L under the locking element 8). The modification according to the invention in the form of removal of the balancing layer 34 in the whole area P eliminates both the bias and the strip-bending resulting from moisture movement.

In order to save on materials, in this embodiment the width W of the strip 6 has been reduced as much as possible to a value which is less than 1.3 times the floor thickness.

The tongue groove depth G of the tongue groove 36 has also been limited as much as possible both to counteract undesirable strip-bending and to save on materials. In its lower part, the tongue groove 36 has been given an oblique part 45 in order to make the tongue groove 36 and the joint portion P more rigid.

In order to counteract the effect of the strip-bending and to comply with the strength requirements, the locking surface has a minimum inclination of at least 45 degrees and the height of the locking element exceeds 0.1 times the floor thickness T.

In order to make the locking-groove part of the joint system as stable as possible, the thickness SH of the strip in an area corresponding to at least half the locking distance D has been limited to a maximum of 0.25 times the floor thickness T. The height LH of the locking element has been limited to 0.2 times the floor thickness and this means that the locking groove 14 can be formed by removing a relatively small amount of material.

In more basic embodiments of the invention, only the measure "modification of balancing layer" is used.

Figure 12:
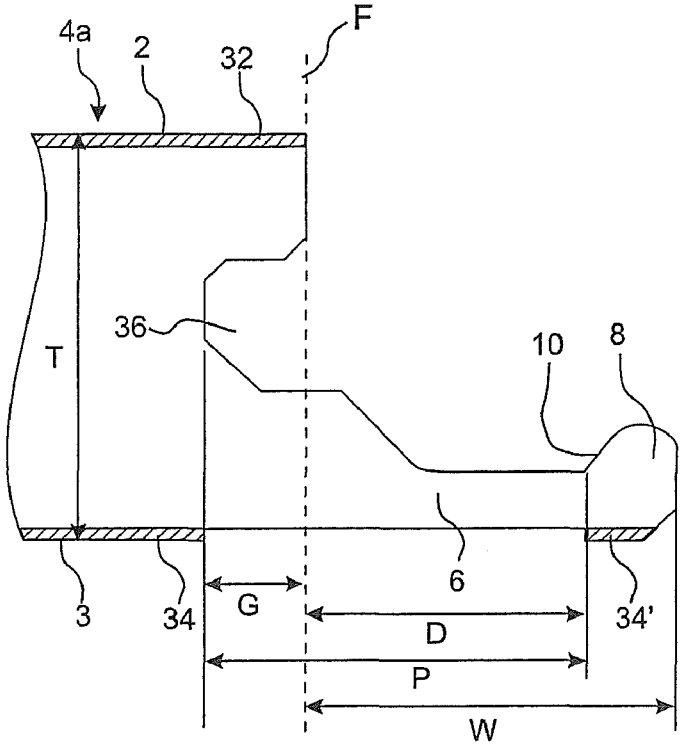
FIGS. 12 and 13 show two alternative embodiments of the invention.

FIG. 12 shows an alternative embodiment for eliminating undesirable strip-bending. Here, the balancing layer 34 has been completely removed within the area P (including area G under the tongue groove). However, under the locking element 8 in the area L the balancing layer is intact in the form of a remaining area 34', which advantageously constitutes a support for the locking element 8 against the subfloor. Since the remaining part 34' of the balancing layer is located outside the locking surface 10 it only has a marginal, if any, negative impact on the change of position of the locking surface 10 in connection with strip-bending and thus changes in moisture content.

Within the scope of the invention there are a number of alternative ways of reducing strip-bending. For example, several grooves of different depths and widths can be formed in the balancing layer within the entire area P and L. Such grooves could be completely or partially filled with materials which have properties that are different from those of the balancing layer 34 of the floorboard and which can contribute to changes in the properties of the strip 6 with respect to, for example, flexibility and tensile strength. Filling materials with fairly similar properties can also be used when the objective is to essentially eliminate the bias of the balancing layer.

Complete or partial removal of the balancing layer P in the area P and refilling with suitable bonding agents, plastic materials, or the like can be a way of improving the properties of the strip 6.

Figure 13:
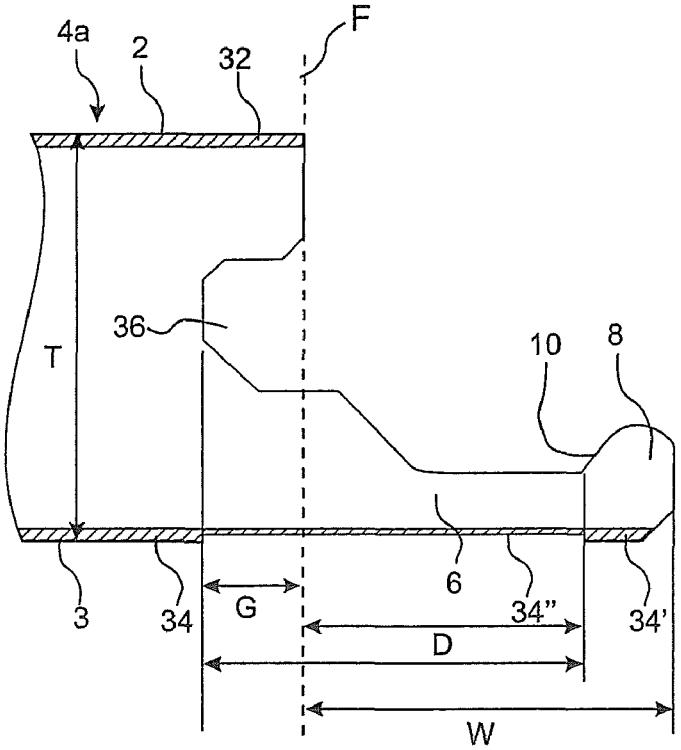

FIG. 13 shows an embodiment in which only part of the outer layer of the balancing layer has been removed across the entire area P. The remaining, thinner part of the balancing layer is designated 34". The part 34' has been left intact under the locking element 8 in the area L. The advantage of such an embodiment is that it may be possible to eliminate the major part of the strip-bending while a part (34") of the balancing layer is kept as a reinforcing layer for the strip 6. This embodiment is particularly suitable when the balancing layer 34 is composed of different layers with different properties. The outer layer can, for example, be made of melamine and decoration paper while the inner layer can be made of phenol and Kraft paper. Various plastic materials can also be used with various types of fibre reinforcement. Partial removal of layers can, of course, be combined with one or more grooves of different depths and widths under the entire joint system P+L. The working from the rear side can also be adapted in order to increase the flexibility of the strip in connection with angling and snap action.

Two main principles for reducing or eliminating strip-bending have now been described namely: (a) modifying the balancing layer within the entire area P or parts thereof, and (b) modifying the joint geometry itself with a reduced tongue groove depth and a special design of the inner part of the tongue groove in combination. These two main principles are usable separately to reduce the strip-bending problem, but preferably in combination.

According to the invention, these two basic principles can also be combined with further modifications of the joint geometry (c) which are characterized in that:

The strip is made narrow preferably less than 1.3 times the floor thickness;

The inclination of the locking surface is at least 45 degrees;

The height of the locking element exceeds 0.1 times the floor thickness and is less than 0.2 times the floor thickness;

The strip is designed so that at least half the locking distance has a thickness which is less than 0.25 times the floor thickness.

The above embodiments separately and in combination with each other and the above main principles contribute to the provision of a strip-lock system which can be manufactured at a low cost and which at the same affords a high quality joint with respect to laying properties, disassembly options, strength, joint opening, and stability over time and in different environments.

Several variants of the invention are possible. The joint system can be made in a number of different joint geometry where some or all of the above parameters are different, particularly when the purpose is to give precedence to a certain property over the others.

Applicant has considered and tested a large number of variants in the light of the above: "smaller" can be changed to "larger", relationships can be changed, other radii and angles can be chosen, the joint system on the long side and the short side can be made different, two types of boards can be made where, for example, one type has a strip on both opposite sides while the other type has a locking groove on the corresponding sides, boards can be made with strip locks on one side and a traditional glued joint on the other, the strip-lock system can be designed with parameters which are generally intended to facilitate laying by positioning the floorboards and keeping them together until the glue hardens, and different materials can be sprayed on the joint system to provide impregnation against moisture, reinforcement, or moisture-proofing, etc. In addition, there can be mechanical devices, changes in the joint geometry and/or chemical additives such as glue which are aimed at preventing or impeding, for example, a certain type of laying (angling or snap action), displacement in the direction of the joint, or a certain way of taking up the floor, for example, upward angling or pulling along the joint edge.

The invention claimed is:

1. A flooring system comprising a plurality of laminate or wood veneer rectangular floorboards having a locking system for mechanical joining of such floorboards, opposite first and second joint edge portions, adjoining floorboards in a mechanically joined position having their first and second joint edge portions joined at a vertical joint plane, said locking system comprising:

a) for vertical joining of the first joint edge portion of a first floorboard and the second joint portion of an adjoining second floorboard mechanically cooperating connectors in the form of a tongue groove formed in the first joint edge portion and a tongue formed in the second joint edge portion, and b) for horizontal joining of the first joint edge portion of the first floorboard and the second joint edge portion of the adjoining second floorboard mechanically cooperating connectors, which comprise:

a locking groove formed in the underside of said second floorboard and extending parallel to and at a distance from the vertical joint plane at said second joint edge portion and having a downward opening, and a strip integrally formed with the body of said first floorboard, said strip projecting at said first joint edge portion from said vertical joint plane and at a distance from the vertical joint plane having a locking element, which projects towards a horizontal plane containing the upper side of said first floorboard and which has at least one operative locking surface for co-action with said locking groove, wherein the strip forms a horizontal extension of the first joint edge portion below the tongue groove, and wherein the locking surface of the locking element is inclined relative to the horizontal plane at an angle of at least 45°, wherein the tongue groove depth as measured from the vertical joint plane and inwards towards the floorboard to a vertical limiting plane which coincides with the innermost portion the tongue groove is less than 0.4 times the thickness of the floorboard, and wherein the strip width as measured outwards from the vertical joint plane to a vertical limiting plane which coincides with the outermost tip of the strip is less than 1.3 times the thickness of the floorboard.

2. The flooring system according to claim 1, wherein the floorboards have a thickness of about 7-10 mm.

3. The flooring system according to claim 1, wherein the floorboards exhibit an upper surface layer of about 0.2-0.8 mm.

4. The flooring system according to claim 1, wherein the floorboards have a body of fibreboard about 6-9 mm.

5. The flooring system according to claim 1, wherein the floorboards have a balancing layer of about 0.1-0.6 mm on the rear side of the floorboards.

6. The flooring system according to claim 1, wherein the tongue groove depth is larger than the width of the tongue as measured outwards from the vertical joint plane to a vertical limiting plane which coincides with the tip of the tongue.

7. The flooring system according to claim 1, wherein the locking system is adapted such that the tongue is anglable into the tongue groove and the locking element is insertable into the locking groove by means of a mutual angular movement of the first and the second floorboard while maintaining contact between joint edge surface portions of the floorboards close to the boundary line between the vertical joint plane and the upper side of the floorboards.

8. The flooring system according to claim 1, wherein the locking system is adapted such that the floorboards are joinable through a snap action, which is incurred by a horizontal displacement of first and the second floorboards towards each other, whereby the strip is forced to move downwards as a direct result of the bringing together of the floorboards and then snaps up and allows the locking element to enter the locking groove.

9. The flooring system according to claim 1, wherein the floorboards on the upper side of the body have a surface layer which coacts with a balancing layer.

10. The flooring system according to claim 1, wherein the locking surface of the locking element has a vertical extent which is at least 0.1 times the thickness of the floorboard.

11. The flooring system according to claim 1, wherein the tongue groove exhibits an outer part with a vertical height and an inner, narrower part with a vertical height whose average value across the horizontal extent of the inner part is less than 0.8 times the vertical height of the outer part.

12. The flooring system according to claim 10, wherein the locking surface of the locking element has a vertical extent which is less than 0.2 times the thickness of the floorboard.

13. The flooring system according to claim 1, wherein the strip, across at least half of the part of the strip which in the horizontal direction is located between the locking surface and the joint edge of the other floorboard, exhibits a strip thickness which is less than 0.25 times the thickness of the floorboard.

14. The flooring system according to claim 12, wherein the floorboards are mechanically joinable to adjoining boards along all four sides by means of said locking system.

15. The flooring system according to claim 6, wherein the locking groove has a larger width than the locking element.

16. The flooring system according to claim 1, wherein the floorboards are of the size of about 1.2 m×0.2 m.

17. The flooring system according to claim 1, wherein the strip, across at least half of the part of the strip which in the horizontal direction is located between the locking surface and the joint edge of the other floorboard, exhibits a constant thickness.

* * * * *